United States Patent [19]

Remington

[11] 4,364,150

[45] Dec. 21, 1982

[54] HANDLE FOR LUGGAGE AND THE LIKE

[75] Inventor: Richard C. Remington, Pompton Plains, N.J.

[73] Assignee: Kidde, Inc. (Presto Lock Company Division), Garfield, N.J.

[21] Appl. No.: 175,915

[22] Filed: Aug. 6, 1980

[51] Int. Cl.[3] ..... A45C 13/26

[52] U.S. Cl. ..... 16/126; 190/57

[58] Field of Search ..... 16/126; 190/57, 58 R

[56] References Cited

U.S. PATENT DOCUMENTS

| | | | |
|---|---|---|---|
| D. 236,429 | 8/1975 | Stolarz . | |
| 2,913,080 | 11/1959 | Louik et al. | 190/57 |
| 3,500,973 | 3/1970 | Bush | 190/57 |
| 3,692,155 | 9/1972 | Laurita | 190/57 |
| 3,737,944 | 6/1973 | Szabo | 16/126 X |
| 4,261,078 | 4/1981 | Edwards et al. | 16/126 |
| 4,280,247 | 7/1981 | Burzen et al. | 190/57 X |

FOREIGN PATENT DOCUMENTS

| | | | |
|---|---|---|---|
| 691576 | 7/1964 | Canada | 16/126 |

*Primary Examiner*—Andrew V. Kundrat

*Attorney, Agent, or Firm*—Shapiro and Shapiro

[57] ABSTRACT

A handle for luggage cases and the like includes a grip molded from resilient, low durometer plastic and means for mounting the grip on a case and for supporting the weight of the case. The grip is formed with a cavity in a central portion thereof and has a plurality of resilient members within the cavity, the members adapted to be deformed when the handle is grasped to allow the central portion to flex to impart a soft feel to the grip. The handle may also include a shell assembled on the grip, and a clip having first projections adapted to enter an opening in the shell and a second projection adapted to be received in a slot in the grip, for holding the shell and the grip in assembled relationship.

26 Claims, 13 Drawing Figures

HANDLE FOR LUGGAGE AND THE LIKE

BACKGROUND OF THE INVENTION

The present invention relates to handles for luggage cases and the like.

As is well known, carrying handles for luggage cases and the like must have adequate strength to support the weight of the case when it is fully loaded. In addition, it is desirable for the handles to have a soft cushion feel in the grip area and an esthetically pleasing appearance. To achieve these characteristics, some previous handles for luggage have been formed of molded plastic, and have been provided with a foam or sponge rubber insert in the grip area which is wrapped with a cover, as of vinyl, to impart a soft feel to the handle. The handles may also have a metal shell on their top side for completing the assembly of the handle and for imparting strength to the handle. Although prior handles may have good strength, a soft feel and an esthetically pleasing appearance, the cost of producing such handles has been very high, primarily due to the labor involved in their assembly.

SUMMARY OF THE INVENTION

Accordingly, it is a principal object of the invention to provide a low-cost handle for luggage and the like which has a soft cushion feel in the grip area of the handle, an esthetically pleasing appearance, and good strength.

Briefly stated, in accordance with one aspect of the invention, a handle for luggage cases and the like is provided which comprises a grip formed of molded resilient material, the grip having a central portion with an interior cavity formed therein and a plurality of resilient members within the cavity, the members adapted to be deformed when the handle is grasped to allow the central portion to flex to impart a soft feel thereto, and means for mounting the grip on the case and for supporting the weight of the case.

In accordance with another aspect, in a handle for luggage cases and the like having a grip formed of molded resilient material and a rigid shell assembled on the grip, a clip for holding the shell and the grip in assembled relationship comprises a base, a leg extending from the base, the leg having first projection means adapted to enter an opening in the shell, and second projection means extending from the base, the second projection means adapted to be received in a slot in the grip.

In accordance with another aspect, the invention provides a handle for luggage cases and the like which includes a grip formed for resilient material having a central portion. A shell is assembled on an upper surface of the grip and a rigid insert is located in the central portion of the grip adjacent to the shell, the grip and the insert having a longitudinal slot therein. A wire form is located within the longitudinal slot and has end portions adapted to be received in corresponding handle studs for mounting the handle on a case.

In accordance with still another aspect, in a handle for luggage cases and the like having a grip with a pair of handle mounting elements projecting from opposite ends of the grip, the handle mounting elements adapted to be received within handle studs for mounting the handle on the case, detent means are provided for holding the handle in an upright position on the case.

DESCRIPTION OF THE PREFERRED EMBODIMENTS

Figure 1:
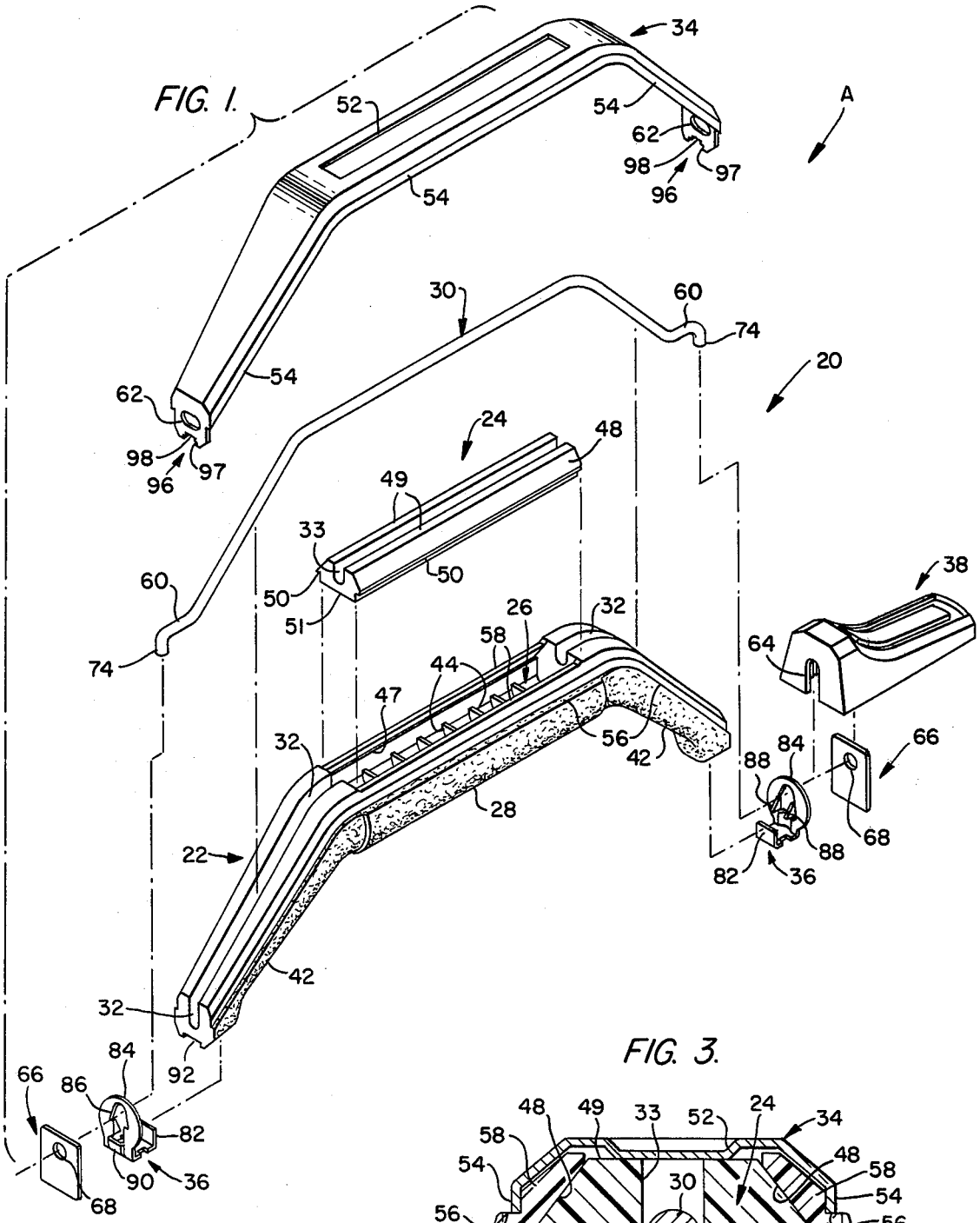
FIG. 1 is an exploded perspective view of a first embodiment of a handle assembly in accordance with the invention.
Figure 2:
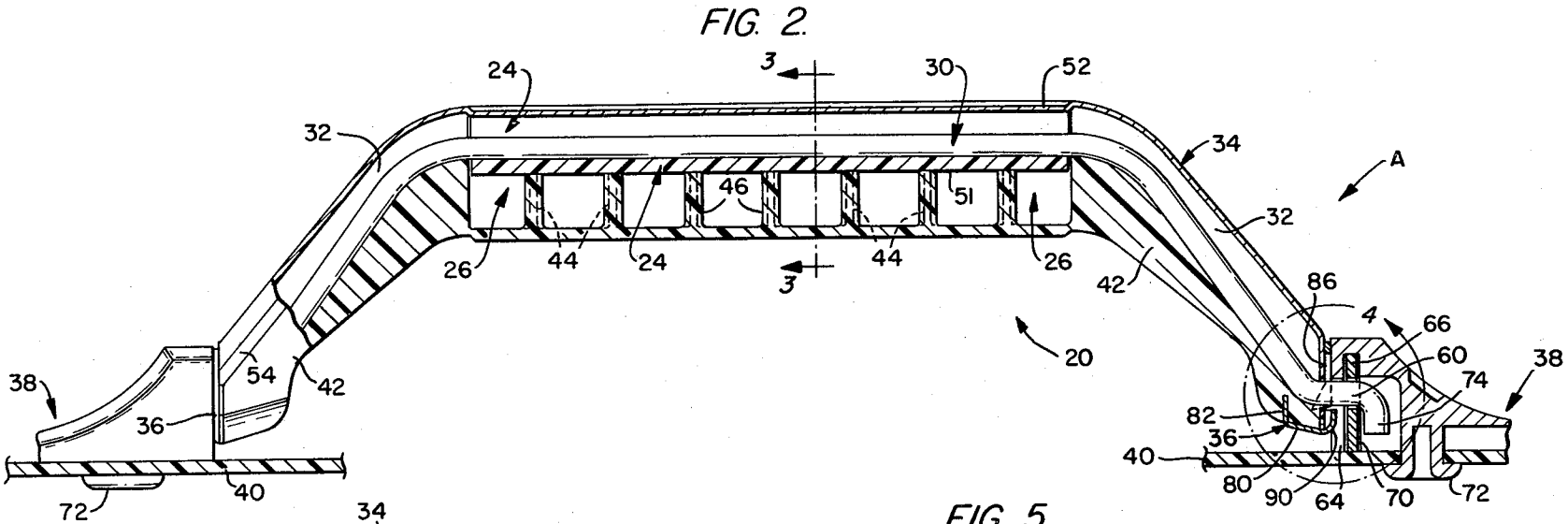
FIG. 2 is a longitudinal sectional view of the handle assembly of FIG. 1.

FIGS. 1–10 illustrate a first embodiment of a handle assembly A in accordance with the invention. As shown in FIG. 1, and as will be described in detail hereinafter, the handle assembly includes a handle 20 which may generally comprise a grip 22, an insert 24 positioned within a cavity 26 formed in the central portion 28 of the grip, a wire form 30 shaped to conform with a grip and located within longitudinal grooves 32 and 33 formed in the upper surfaces of the grip and the insert, respectively, and a shell 34 positioned on the upper surface of the grip. The handle may further include clips 36 for holding the shell and the grip in assembled relationship, and handle studs 38 may be provided for pivotally mounting the handle on a carrying case 40, as shown in FIG. 2, for example.

Figure 7:
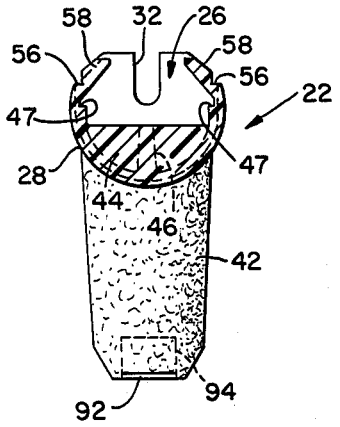
FIG. 7 is a transverse sectional view taken approximately along the line 7—7 of FIG. 6.
Figure 8:
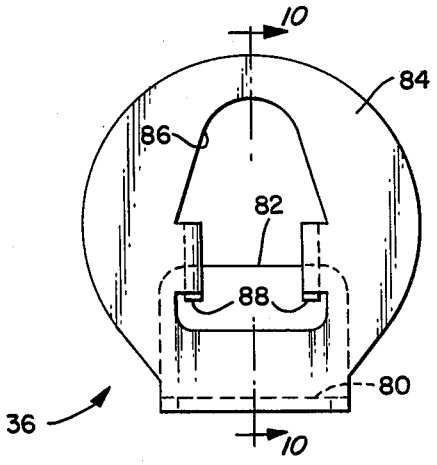
FIG. 8 is an end view of a clip which may be employed in the handle assembly of FIG. 1.
Figure 9:
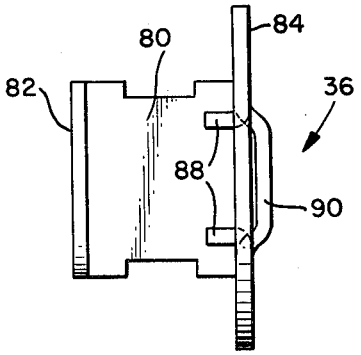
FIG. 9 is a top plan view of the clip of FIG. 8.
Figure 10:
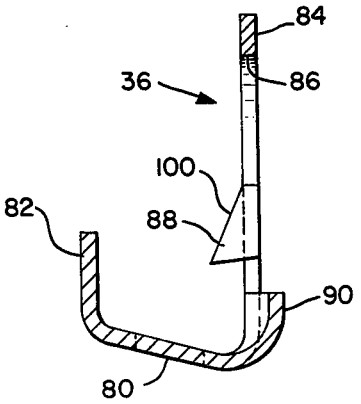
FIG. 10 is a sectional view taken approximately along the line 10—10 of FIG. 8.

Grip 22 is preferably formed of a resilient low durometer molded plastic material, such as vinyl, with a shape as illustrated in FIGS. 1, 2, 6 and 7. The grip may be molded with a grainy exterior surface finish to give it the appearance of leather. As shown in FIGS. 1 and 2, the grip has a pair of legs 42 which extend outwardly and downwardly from its central portion 28. A plurality of resilient members 44 are located within cavity 26 in the central portion of the grip, the resilient members preferably being constituted as webs extending in a transverse direction with respect to the grip and formed integrally with the interior surfaces of the cavity. As best illustrated in FIGS. 2 and 7, the resilient members are located in the lower half of the cavity, their height being approximately ½ the depth of the cavity, and have a central, vertically extending (in FIGS. 2 and 7) embossed portion 46, which serves to strengthen the resilient members.

Figure 3:
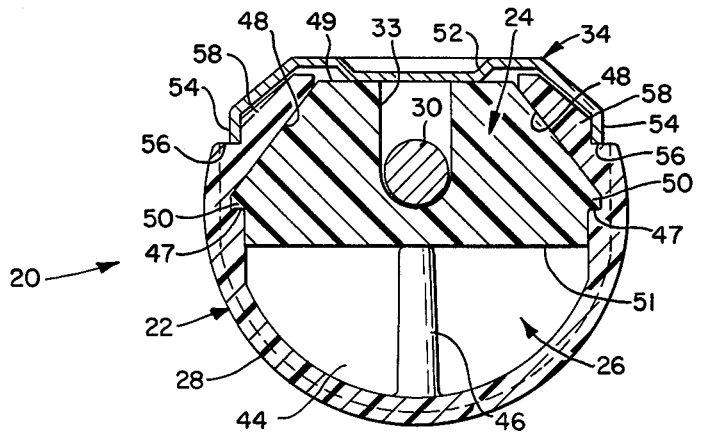
FIG. 3 is an enlarged transverse sectional view taken approximately along the line 3—3 of FIG. 2.

As shown in FIGS. 3 and 7, the interior side walls of the cavity extend upwardly from the resilient members, then outward slightly to form a longitudinal groove 47 in each interior side wall (see FIG. 6 also) which is coextensive with the central portion 28 of the grip. The side walls are then tapered inwardly and upwardly, as shown, imparting to the upper portion of the cavity a generally trapezoidal shape.

As shown in FIGS. 1 and 3, insert 24 has a cross sectional shape which is also generally trapezoidal and which conforms to the shape of the upper portion of cavity 26 so that the insert may be received therein. The length of insert 24 is coextensive with the central portion 28 of the grip, and the side walls 48 of the insert slope downwardly and outwardly from its top 49 to form projections 50 which are received in longitudinal grooves 47. The bottom 51 of the insert rests on the tops of resilient members 44. The resilient members 44 and the longitudinal grooves 47 support the insert in the upper portion of the cavity, and the spaced resilient members 44 segment the lower portion of the cavity into a plurality of smaller cavities (see FIGS. 1, 2 and 6). As will be explained hereinafter, when the case is lifted by the handle, the resilient members are resiliently deformed against the insert. This allows the central portion of the grip to flex and imparts a very soft cushion feel to it.

As shown in FIG. 3, when the shell 34, which is preferably stamped steel, is assembled with the grip 22, a central longitudinally extending depression 52 in the shell engages the top 49 of the insert. The sides 54 of the shell are preferably chamfered, as shown, and are located in longitudinally extending notches 56 in the exterior side walls of the grip. Sides 54 of the shell cooperate with sides 48 of the insert to form longitudinal slots which receive the sides 58 of the grip. Engagement between sides 54 of the shell and notches 56 serves to retain the sides 58 of the grip within the slots formed between the shell and the insert. Preferably, insert 24 is formed of a rigid plastic material so that when the shell is assembled with the grip, the resilient sides of the grip are slightly compressed between sides 54 of the shell and sides 48 of the insert.

Figure 4:
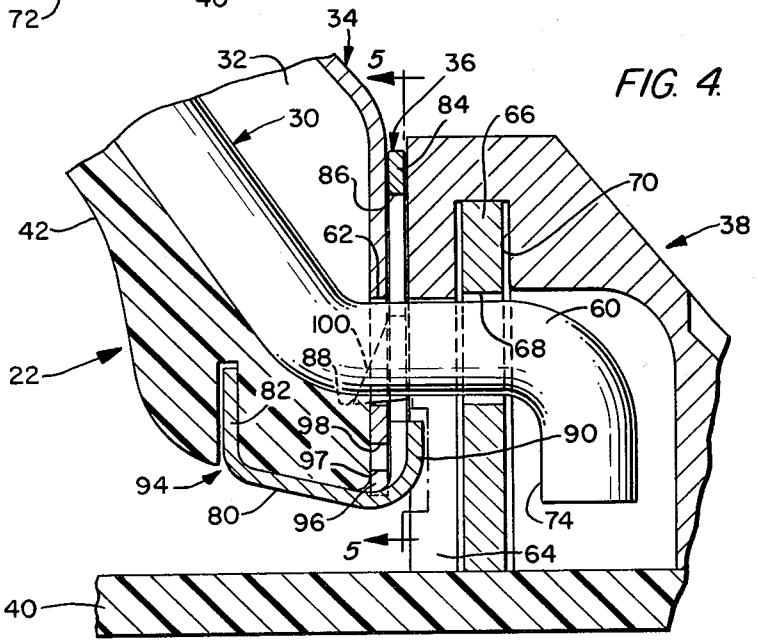
FIG. 4 is an enlarged fragmentary sectional view of the area enclosed within the line 4 of FIG. 2.
Figure 6:
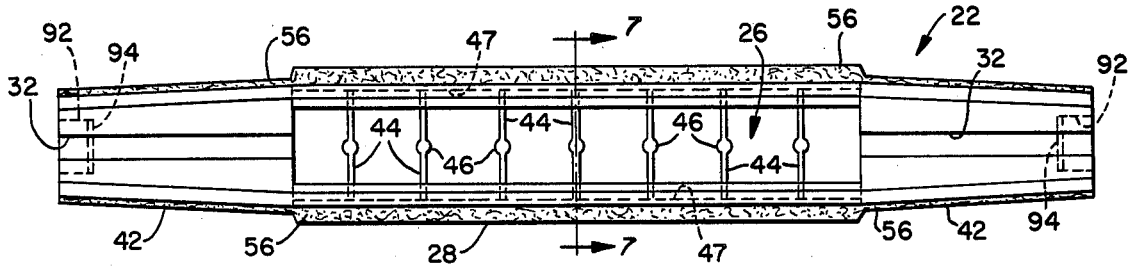
FIG. 6 is a top plan view of a grip which may be employed in the handle assembly of FIG. 1.

Wire form 30 is preferably formed of steel rod and, as previously mentioned, is located within a longitudinally extending slot 32 in the tops of legs 42 of the grip and a corresponding slot 33 in the top of insert 24. As shown in FIGS. 2 and 4, the ends 60 of the wire form extend longitudinally from the ends of the grip 22 through elongated openings 62 in the ends of shell 34, and may be received within handle studs 38 for pivotally mounting the handle 20 on case 40. For this purpose, the handle studs may have a vertical slot 64 in their end walls adjacent to the handle 20 (FIG. 1). To support the handle on the handle studs, a bracket 66 may be located on each end 60 of the wire form. The brackets may be substantially planar members as illustrated, having a hole 68 for receiving an end of the wire form. As best illustrated in FIG. 4, each handle stud preferably has an internal groove 70 which receives the bracket 66, in the manner illustrated in FIG. 4, for supporting the end of the wire form within the handle stud. Brackets 66 may be sized so that when the handle studs are attached to case 40, the brackets are confined within grooves 70 by virtue of their engagement with the case. The handle studs may be provided with integrally cast mounting posts 72 which are passed through openings in the case and then expanded, as shown in FIG. 2, to attach the handle studs to the case. The tips 74 of ends 60 may be bent at an angle to prevent the ends from slipping out of the holes 68 in the brackets, thereby securely mounting the handle on the handle studs.

In order to retain the shell 34 and the grip 22 in assembly relationship, a clip 36 may also be located on each end 60 of the wire form. The clips may be substantially J-shaped as illustrated in FIGS. 1, 2, 4 and 10, having a base 80 with first and second legs 82 and 84, respectively, projecting therefrom. A centrally located opening 86 may be positioned in leg 84 for passing end 60 of the wire form. A pair of triangularly shaped tabs 88 may project inwardly from opposite edges of opening 86 toward leg 82, and leg 84 may have a protrusion 90 located below opening 86 which projects in the opposite direction from tabs 88 slightly beyond the plane of leg 84 (see FIGS. 4 and 10). The clips, which are preferably formed of steel, serve to hold the shell assembled with the grip in the following manner.

Figure 5:
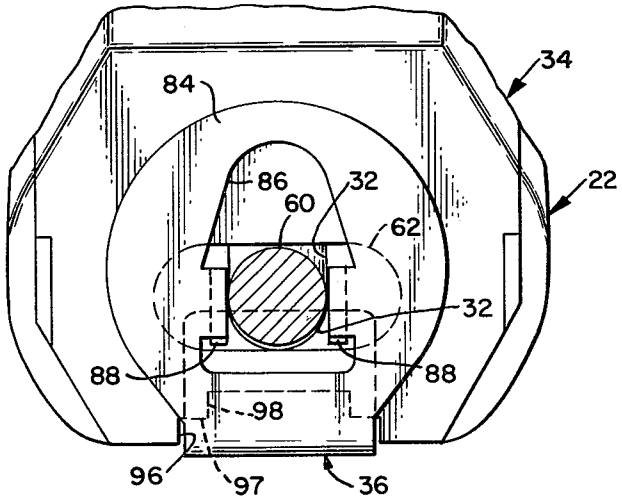
FIG. 5 is a transverse sectional view taken approximately along the line 5—5 of FIG. 4.

Referring particularly to FIGS. 4 and 5, the clip is adapted to be located on an end 60 of the wire form between the shell 34 and the handle stud 38. Projecting tabs 88 are formed to enter the elongated opening 62 in the end of the shell on opposite sides of end 60 of the wire form (FIG. 5). Each end of grip 22 may be formed with a recess 92 on its underside (FIGS. 1, 6 and 7) for receiving the base 80 of an associated clip. The underside of each end of the grip may also be formed with a slot 94, as best illustrated in FIG. 4, for receiving leg 82 of the clip when the base 80 is located in the recess 92. The engagement between tabs 88 and the shell, and the engagement of base 80 and leg 82 of the clip with the grip, serve to hold the shell and the grip in assembly relationship.

As best illustrated in FIG. 4, protrusion 90 of the clip is sized to enter the vertical slot 64 in the handle stud 38 when the handle 20 is in an upright position (the position illustrated in FIG. 2). Protrusion 90 serves as a detent which cooperates with slot 64 to retain the handle in the upright position on the case until it is moved to a lowered position. When the handle is lowered from the upright position, protrusion 90 is cammed out of slot 64 by virtue of its engagement with a side of the slot. The shell 34, which is preferably formed of stamped steel, and the grip 22 have sufficient resiliency so that the ends of the handle are moved together slightly as the protrusions on the clips are cammed out of the slots in the spaced handle studs 38. When the handle is later raised to an upright position, the protrusions 90 enter the slots 64 in the handle studs with an audible click and retain the handle in the upright position until it is lowered by the user. This is a very convenient feature of the handle assembly, since it facilitates grasping of the handle.

Handle 20 may be assembled in the following manner. First, the wire form 30 is inserted into the elongated holes 62 in the ends of the shell 34. This may be accomplished by orienting the shell at right angles to the wire form, inserting one end 60 of the wire form into one opening 62, and positioning the wire form to allow its opposite end to be inserted into the elongated hole in the opposite end of the shell. The wire form may be then rotated to its normal position in alignment with the shell. Insert 24 may be located within cavity 26 in grip 22, and the grip and insert may be located on the shell with the wire form positioned in longitudinal slots 32 and 33. A clip may then be inserted over each end 60 of the wire form and pushed into position so that the triangular tabs snap into the elongated opening 62 in the shell and leg 82 of the clip is positioned in slot 94 of the grip.

To facilitate assembly of the clip with the grip and the shell, the ends of shell 34 may be formed with a stepped cut-out 96, as shown in FIGS. 1 and 5. The lower, widest portion 97 of cut-out 96 provides access to recess 92 of the grip for base 80 of the clip, as shown in FIG. 4. The narrower, upper portion 98 of cut-out 96 is provided to facilitate assembly of the clip with the shell and grip, as will now be described.

In assembling the clip with the grip and the shell, the clip may be initially placed on end 60 of the wire form with end 60 positioned in the upper (in FIG. 5) portion of opening 86, and the clip slid toward the shell to align leg 82 with slot 94 in the grip. The upper portion 98 of cut-out 96 provides clearance for the tips of the triangular tabs 88 to allow leg 82 and slot 94 to be aligned. When aligned, the clip may then be pushed upwardly (in FIG. 4). This causes inclined surfaces 100 of the triangular tabs to engage the edge of the upper portion 98 of the cut-out, causing the triangular tabs and leg 84 to be cammed outward slightly until the triangular tabs snap into elongated opening 62 and leg 82 enters slot 94. When assembly of the handle is completed, brackets 66 may be slipped onto the ends of the wire form and the brackets may be positioned in grooves 70 of the handle studs. The handle studs may then be attached to case 40 to complete the assembly.

When the handle is grasped to lift the case, resilient members 44 are resiliently deformed, in accordance with the amount of pressure applied to the central portion 28 of the grip, by virtue of their engagement with the bottom 51 of insert 24. This allows the central portion to flex, which imparts a very soft cushion feel to it, the softness being dependent upon the number of resilient members 44 provided. When the case is lifted, the lifting force is transmitted through the resilient members to insert 24 and to wire form 30. The insert distributes the lifting force along the wire form and the wire form transmits the lifting force to the case through the handle studs 38. The wire form supports the entire load of the case and is the major structural component for imparting strength to the handle. It also serves to support the other components of the handle. Shell 34 serves primarily to maintain the grip, the insert and the wire form in assembled relationship.

Figure 11:
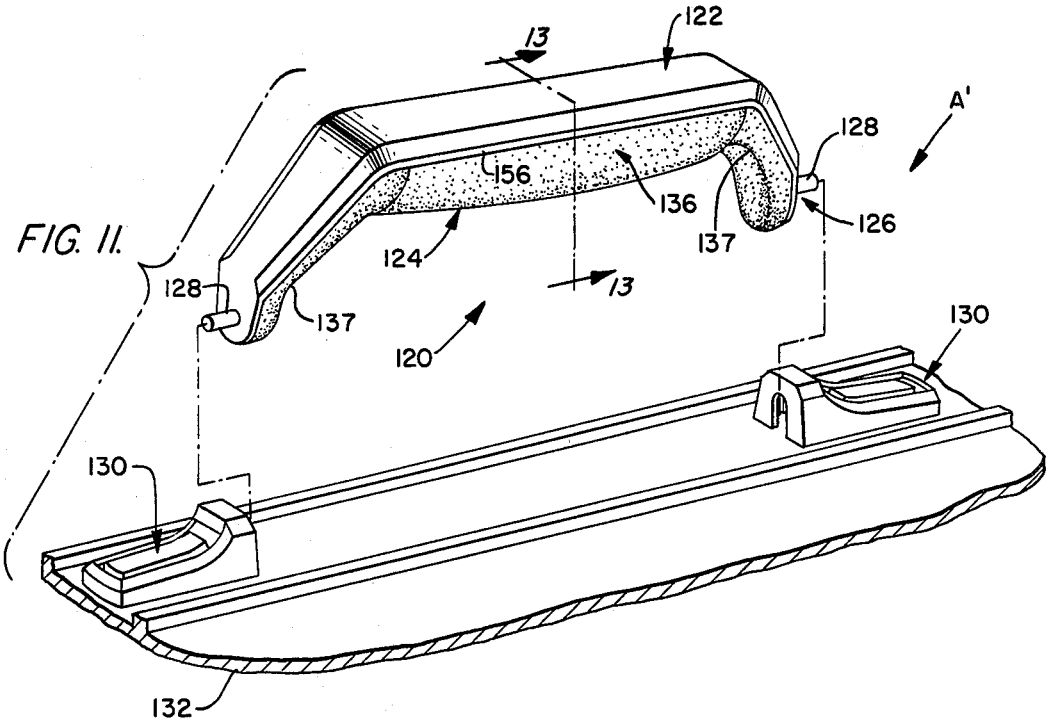
FIG. 11 is an exploded perspective view of a second embodiment of a handle assembly in accordance with the invention.
Figure 12:
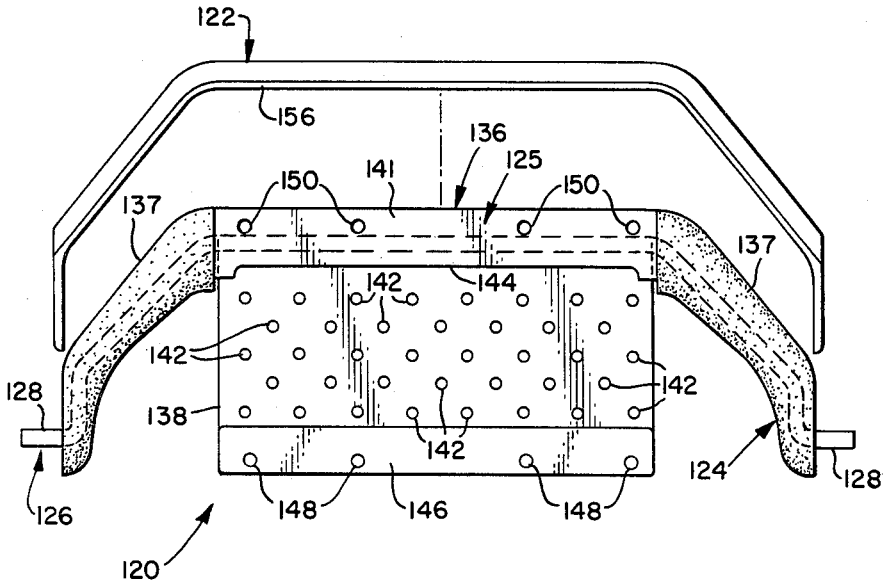
FIG. 12 is an exploded perspective view illustrating the handle of the assembly of FIG. 11.
Figure 13:
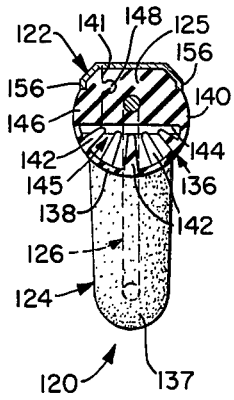
FIG. 13 is a transverse sectional view taken approximately along the line 13—13 of FIG. 11.

FIGS. 11–13 illustrate a second embodiment of a handle assembly A′ in accordance with the invention. Except for handle 120, handle assembly A′ may be similar to handle assembly A of the first embodiment. Handle 120 achieves a soft cushion feel in its grip area in a similar manner to that of the first embodiment. However, the construction of handle 120 is somewhat different from the construction of the handle of the first embodiment, as will now be described.

As illustrated in FIGS. 11–13, handle 120 comprises a shell 122, preferably formed of metal, and a molded grip 124, preferably formed of low durometer plastic material, such as vinyl. A wire form 126 may be molded within the grip 124, as shown in FIGS. 12 and 13, or the grip may be provided with a longitudinal slot into which the wire form is snapped after the grip is molded. The ends 128 of the wire form may be received in handle studs 130 for supporting the handle, and the handle studs may be attached to a case 132 in the same manner as described for the first embodiment.

As shown in FIGS. 12 and 13, the central portion 136 of grip 124 comprises an upper part 125 and an integral flap 138 depending from one side 140 of the upper part of the central portion, and the opposite side 141 of the upper part of the central portion may be recessed inwardly and upwardly, as shown, with respect to the legs 137 of the grip. Flap 138 may have a plurality of finger-like resilient projections or members 142 formed on one surface thereof. The flap is adapted to be wrapped around the underside 144 of the upper part of the central portion of the grip in the manner illustrated in FIG. 13, to form a cavity 145 in which the resilient members are located. The free end 146 of the flap may be shaped to mate with the recess in side 141 of the central portion and may be formed with integrally molded dowels 148 which are received in corresponding holes 150 in side 141, to attach the end 146 to the upper part of the central portion, as shown in FIG. 13. This positions the tips of resilient members 142 adjacent to the underside 144 of the central portion, as shown. In addition, the flap is preferably sized with respect to the recessed central portion so that when it is wrapped around and attached to side 141, the grip has the appearance of being a unitary structure, as shown in FIG. 11.

Resilient members 142 function in the same manner as resilient members 44 of the first embodiment to impart a soft cushion feel to the central portion of the grip. When the handle is grasped, the resilient members are resiliently deformed against the underside 144 of the upper part 125 of the central portion of the grip, allowing the central portion to flex to impart the soft feel. The number of members 142 provided on flap 138 determines the softness of the grip, in a similar manner to that previously described for the first embodiment.

To assemble the handle, flap 138 is first wrapped around the underside 144 of the upper part 125 of the central portion of the grip and dowels 148 are positioned in corresponding holes 150 in side 141. Grip 124 may then be positioned at an angle with respect to shell 122 and ends 128 of the wire form located in corresponding holes in the ends of the shell. The grip may then be rotated into alignment with the shell. Preferably, the shell, the grip, and the wire form are sized so that the grip is slightly compressed by the shell, and so that the chamfered sides 156 of the shell bite into the sides of the grip (as illustrated in FIG. 13) to hold the grip and the shell in assembled relationship.

Although the ends 128 of the wire form 126 are illustrated as being straight in the second embodiment, their tips may also be bent in the manner described for the first embodiment, and the handle 120 may be mounted on the handle studs 130 in the same manner as for the first embodiment. In addition, clips similar to clips 36 employed in the first embodiment may be used to improve the attachment of the shell to the grip, and to provide a detent for the handle, as previously described, to hold it in an upright position on the case.

From the foregoing, it will be appreciated that handles in accordance with the invention overcome the disadvantages of prior art handles. The handles of the invention have a soft cushion feel in their grip area, an esthetically pleasing appearance, and good strength. Moreover, the handles of the invention are very economical to produce, having a relatively inexpensive construction and being capable of rapid assembly.

While preferred embodiments of the invention have been shown and described, it will be apparent to those skilled in the art that changes can be made in these embodiments without departing from the principles and spirit of the invention, the scope of which is defined in the appended claims.

I claim:

1. A handle for luggage cases and the like comprising a grip formed of resilient material, the grip having a central portion with an interior cavity formed therein and a plurality of resilient members integrally formed on an interior surface of the grip within the cavity, the members adapted to be deformed when the handle is grasped to allow the central portion to flex to impart a soft feel thereto, and means for mounting the grip on the case and for supporting the weight of the case, the mounting means comprising a wire form within the grip and the central portion including an insert positioned within the cavity between the resilient members and the wire form, the resilient members being adapted to be deformed by engagement with the insert.

2. The handle of claim 1, further comprising a shell assembled on an upper surface of the grip, the longitudinal sides of the shell being chamfered and cooperating with the longitudinal sides of the insert to form slots for receiving and retaining the side walls of the grip.

3. The handle of claim 2, wherein the grip and the insert have a longitudinal slot therein for receiving the wire form, the wire form having end portions which project from opposite ends of the grip through openings in the shell for mounting the handle on the case.

4. The handle of claim 3 further comprising a clip located on each end portion, the clip having means for engaging the shell and the grip for maintaining the shell and the grip in assembled relationship.

5. The handle of claim 4, wherein the engaging means comprises a first projection adapted to enter one of said openings in the shell, and a second projection adapted to be received in a slot in the grip.

6. The handle of claim 3, wherein each clip has detent means cooperable with a slot in a corresponding handle stud adapted to be attached to the case and to receive a corresponding end portion for mounting the handle on the case, the detent means and the slot being cooperable for holding the handle in an upright position on the case.

7. The handle of claim 3, further comprising a bracket located on each of said end portions, the brackets adapted to be received in a groove within corresponding handle studs adapted to be attached to the case for pivotally mounting the handle on the case.

8. The handle of claim 7, wherein each bracket has a hole therein for receiving a corresponding end portion and the end portions have their tips bent to retain the brackets thereon.

9. A handle for luggage cases and the like comprising a grip formed of resilient material, the grip having a central portion with an interior cavity formed therein and a plurality of resilient members within the cavity, the central portion comprising an upper part having an integral flap depending from a first side of the upper part, the flap having said resilient members formed thereon and being wrapped around an underside of the upper part and having an end attached to a second side of the upper part to form said cavity, the members adapted to be deformed when the handle is grasped to allow the central portion to flex to impart a soft feel thereto, and means for mounting the grip on the case and for supporting the weight of the case.

10. The handle of claim 9, wherein the end of the flap which is attached to the second side has molded dowels formed thereon which are received in cooperable holes in said second side for attaching the end thereto.

11. The handle of claim 9, wherein the resilient members are adapted to be deformed by engagement with the upper part.

12. The handle of claim 9, further comprising a shell assembled on an upper surface of the grip, the longitudinal sides of the shell being chamfered and formed to engage the sides of the grip to maintain the shell and the grip in assembled relationship.

13. The handle of claim 9 further comprising a shell assembled on an upper surface of the grip, and wherein the mounting means comprises a wire form within the grip, the wire form having end portions which project from opposite ends of the grip through openings in the shell for mounting the handle on the case.

14. The handle of claim 13, wherein the wire form is molded within the grip.

15. The handle of claim 1 or 9, wherein the grip is of low durometer plastic formed to have the appearance of leather.

16. A handle for luggage cases and the like comprising a grip formed of resilient material, the grip having a central portion, a shell assembled on an upper surface of the grip, a rigid insert located in the central portion of the grip adjacent to the shell, the grip and the insert having a longitudinal slot therein, and a wire form located within the longitudinal slot, the wire form having end portions adapted to be received in corresponding handle studs for mounting the handle on a case.

17. The handle of claim 16, wherein the end portions project from opposite ends of the grip through corresponding openings in the shell.

18. The handle of claim 17 further comprising a clip located on each of said end portions, the clip having means for engaging the shell and the grip for maintaining the shell and grip in assembled relationship.

19. The handle of claim 18, wherein each clip has detent means cooperable with a slot in a corresponding handle stud for holding the handle in an upright position on the case.

20. In a handle for luggage cases and the like having a grip formed of resilient material and a rigid shell assembled on the grip, a clip for holding the grip and the shell in assembled relationship comprising a base, a leg extending from the base, the leg having first projection means adapted to enter an opening in the shell, and second projection means extending from the base, the second projection means adapted to be received in a slot in the grip.

21. The handle of claim 20, wherein the clip has a protrusion on said leg which is adapted to enter a slot in a handle stud which supports the handle on the case to provide a detent for holding the handle in an upright position.

22. The handle of claim 20, wherein the leg has an opening therein for passing handle mounting means extending from the end of the grip through the opening in the shell, the first projection means being located on opposite edges of the opening in the clip.

23. The handle of claim 20, wherein the clip is substantially J-shaped, and wherein the shell has a cut-out in its end adjacent to said opening and the grip has a recess adjacent to said cut-out, said base being sized to be received in the cut-out and in the recess.

24. The handle of claim 20, wherein the first projection means comprises a pair of triangularly shaped tabs, and said opening comprises an elongated slot in the shell.

25. In a handle for luggage cases and the like having a grip with a pair of handle mounting elements projecting from opposite ends of the grip, the handle mounting elements adapted to be received within handle studs for mounting the handle on a case, detent means for holding the handle in an upright position on the case comprising a projection on an end of the grip adapted to be received in a slot in a corresponding handle stud when the handle is in the upright position and adapted to be cammed out of said slot to permit the handle to be lowered.

26. In a handle for luggage cases and the like having a grip with a pair of handle mounting elements projecting from opposite ends of the grip, the handle mounting elements adapted to be received within handle studs for mounting the handle on a case, detent means for holding the handle in an upright position on the case comprising a projection formed on a clip positioned on one of the handle mounting elements between an end of the grip and a corresponding handle stud, the projection adapted to be received in a slot in the corresponding handle stud when the handle is in the upright position.

* * * * *